United States Patent [19]

Madsen et al.

[11] Patent Number: 4,511,080

[45] Date of Patent: Apr. 16, 1985

[54] INTERLOCKING END CLOSURE FLAPS ON COLLAPSIBLE EIGHT-SIDED RECEPTACLE

[75] Inventors: Roger E. Madsen, Council Bluffs, Iowa; Michael M. Williams, Arlington, Tex.

[73] Assignee: Packaging Corporation of America, Evanston, Ill.

[21] Appl. No.: 542,351

[22] Filed: Oct. 17, 1983

[51] Int. Cl.[3] ..... B65D 5/08

[52] U.S. Cl. ..... 229/41 C; 206/386; 229/38

[58] Field of Search ..... 229/41 C, 41 D, 38, 229/39 R, 23 R, 23 BT; 206/386

[56] References Cited

U.S. PATENT DOCUMENTS

| | | | |
|---|---|---|---|
| 2,307,913 | 1/1943 | Bergstein | 229/39 R |
| 3,622,065 | 11/1971 | Butterfill | 229/38 |
| 3,853,260 | 12/1974 | Wood | 229/39 R |
| 4,199,098 | 4/1980 | Lopez | 229/41 C |
| 4,441,649 | 4/1984 | Nederveld | 229/41 C X |

FOREIGN PATENT DOCUMENTS

| | | | |
|---|---|---|---|
| 1293077 | 4/1969 | Fed. Rep. of Germany | 229/38 |
| 980391 | 1/1965 | United Kingdom | 229/38 |

*Primary Examiner*—William Price
*Assistant Examiner*—Gary E. Elkins
*Attorney, Agent, or Firm*—Neuman, Williams, Anderson & Olson

[57] ABSTRACT

A collapsible receptacle is provided for use in the bulk handling of various articles, such as fresh produce. The receptacle is formed from a blank of foldable sheet material, such as corrugated fibreboard and includes upright first and second wall panels and corner panels interposed said wall panels and foldably connected thereto. The wall and corner panels delimit a predetermined area. Bottom-forming first, second, and third flaps are foldably connected, respectively, to the corresponding bottom edges of the first and second wall panels and the corner panels. Each third flap has one edge thereof separated by a slot from a second flap and has an opposite edge thereof connected by a first foldline to an adjoining edge of a first flap. The distal outer end of each first foldline terminates in a notch. Each third flap has a second foldline which extends outwardly from a corner of the flap to the outer edge thereof whereby the third flap is formed into major and minor portions. When forming the bottom of the receptacle, the first and third flaps are initially folded as a unit into the predetermined area and then the second flaps are folded into the predetermined area whereby opposing edge portions thereof extend through and interlockingly engage the corresponding notches formed between the first and third flaps.

8 Claims, 6 Drawing Figures

FIG. 1
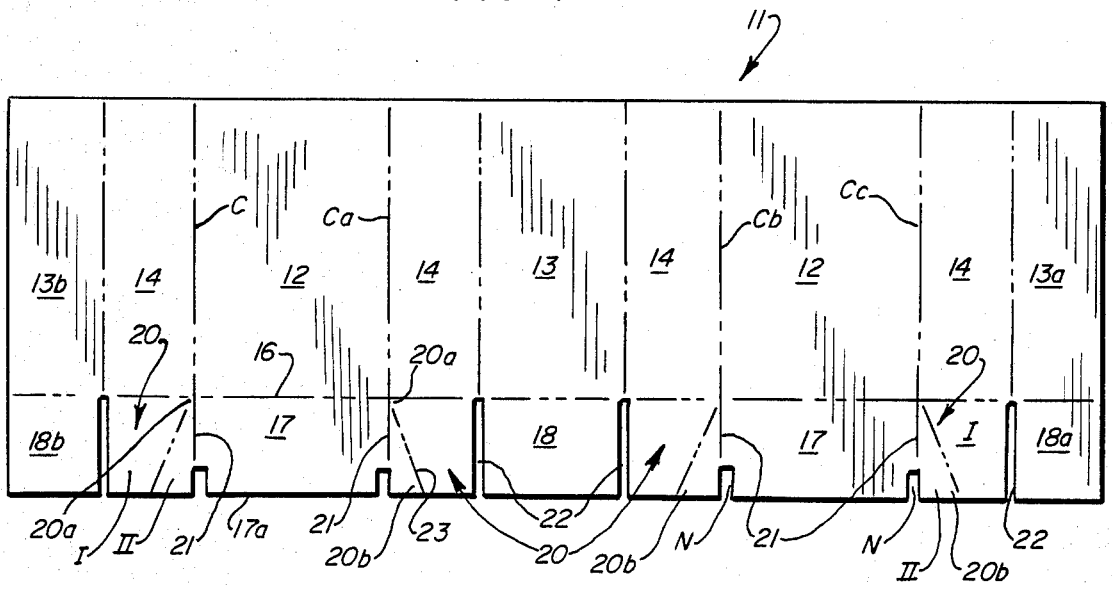
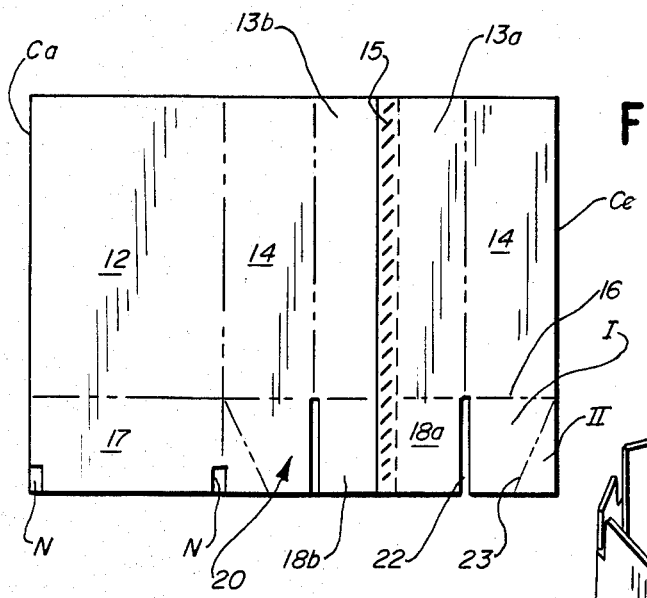
FIG. 2
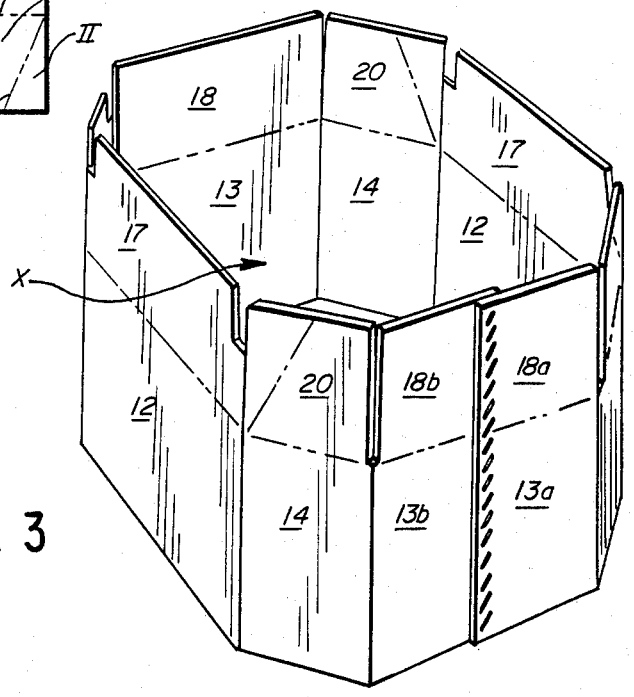
FIG. 3

INTERLOCKING END CLOSURE FLAPS ON COLLAPSIBLE EIGHT-SIDED RECEPTACLE

BACKGROUND OF THE INVENTION

Various receptacles have heretofore been provided for the bulk handling of various types of fresh produce, such as watermelons and the like. Such receptacles, however, because of various design characteristics are beset with one or more of the following shortcomings: (a) they are of a complex and costly construction; (b) they are awkward and difficult to set up requiring special tools and/or jigs to perform such an operation; (c) they are not capable of being collapsed, when not in use, for easy storage or shipment to the packer; and (d) they are not sufficiently strong, when loaded, to withstand normal, sometimes abusive, handling.

SUMMARY OF THE INVENTION

Thus, it is an object of the invention to provide a receptacle of the type described which avoids all of the aforenoted shortcomings.

It is a further object to provide a receptacle which may be readily set up manually by a single individual.

It is a further object to provide a receptacle which is capable of repeated reuse.

It is a still further object to provide a receptacle which is capable, when loaded, of being stacked with other similar receptacles.

It is a still further object to provide a receptacle which may be readily utilized in combination with pallets or the like.

Further and additional objects will appear from the description, accompanying drawings, and appended claims.

In accordance with one embodiment of the invention, a collapsible receptacle is provided which is formed from a blank of foldable sheet material. The receptacle is provided with upright first and second wall panels which are separated from one another by upright corner panels, the latter being foldably connected to the separated first and second wall panels. The wall and corner panels coact to delimit a predetermined area. Foldably connected to the bottom edges of the wall and corner panels are first, second, and third flaps, respectively. Each third flap has one side edge thereof separated by a slot from an adjacent second flap. The opposite side edge of each third flap is connected by a first foldline to the side edge of an adjacent first flap. The outer end of each first foldline terminates in a notch. Each third flap is provided with an outwardly extending, angularly disposed second foldline. The second foldline forms the third flap into contiguous major and minor portions. Each minor portion is sandwiched between the major portion and the first flap connected thereto. Side edges of each second flap extend through and interlockingly engage corresponding notches.

DESCRIPTION

For a more complete understanding of the invention reference is made to the drawings, wherein:

FIG. 1 is a plan view of a blank for one embodiment of the improved receptacle.

FIG. 2 is a plan view of the improved receptacle in a collapsed state.

FIGS. 3–5 are perspective views showing the collapsed receptacle of FIG. 2 in successive stages of being set up.

Figure 5:
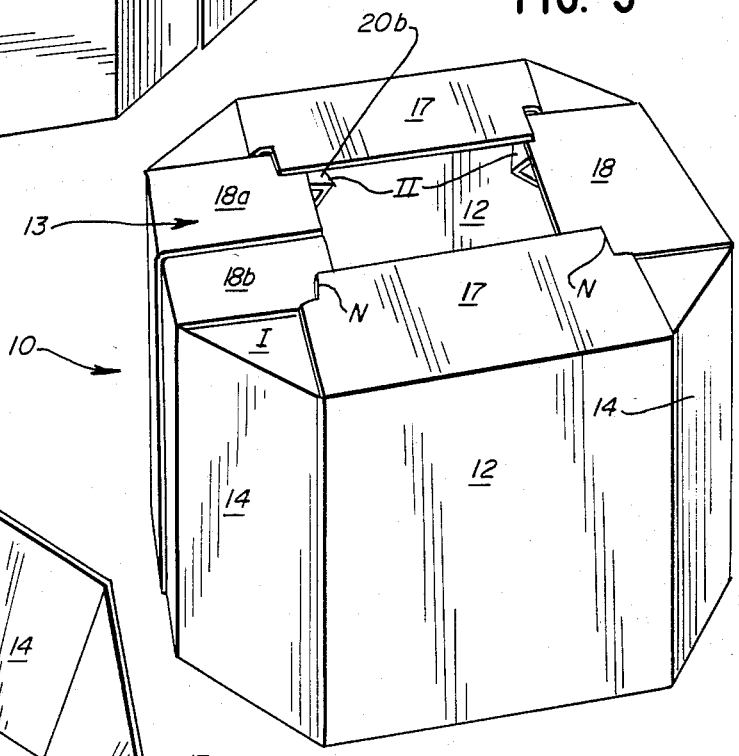
Figure 6:
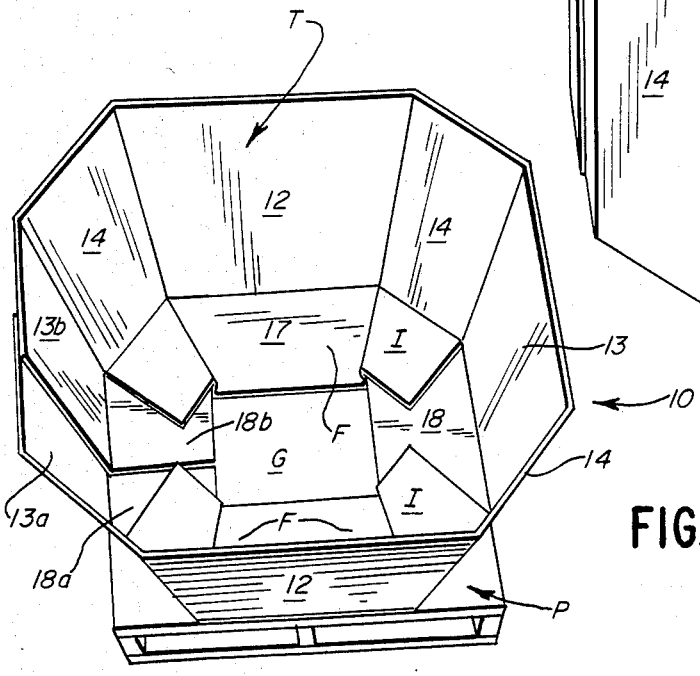
FIG. 6 is a perspective view of the set up improved receptacle ready for loading.

Referring now to the drawings and more particularly to FIGS. 5 and 6, one form of the improved receptacle 10 is shown which is particularly suitable for the bulk handling of various products (e.g. fresh produce, such as watermelons and the like). In FIG. 5 the receptacle 10 is shown in an inverted position which it assumes when being set up as will be described more fully hereinafter. The open top T of the receptacle may be closed by a telescoping cover, not shown, or by closure flaps of the type, to be hereinafter described, utilized in forming the bottom B of the receptacle.

The receptacle 10, shown in FIGS. 5 and 6, is formed from a blank 11 of sheet material, such as conventional triple wall corrugated fibreboard. As seen in FIG. 1, blank 11 includes a plurality of first and second wall panels 12 and 13, respectively, and a plurality of corner panels 14. The panels are arranged in alternate side-by-side relation with a corner panel interposed each first and second wall panel and foldably connected thereto. In the illustrated blank 11, one of the second wall panels is separated into two complemental sections 13*a*, 13*b*, which are disposed at opposite ends of the blank. When the blank is set up to form receptacle 10, the complemental sections partially overlap one another and are secured together by a row of staples 15 or the like, see FIG. 2. In lieu of sections 13*a*, 13*b*, a conventional manufacturers glue flap, not shown, may be provided which would be foldably connected to one side edge of the blank.

Connected by foldline 16 to the corresponding bottom edges of panels 12–14 are first, second, and third flaps 17, 18, and 20, respectively. The flaps coact with one another, as will be described more fully hereafter, to form the bottom B of the receptacle. As is the case with the wall panels, one of the flaps 18 is formed into complemental sections 18*a*, 18*b* which in turn are foldably connected to the bottom edges of wall panel sections 13*a*, 13*b*, respectively. The row of staples 15 effect interconnecting of the flap sections 18*a*, 18*b* when the blank is set up to form the receptacle into either a collapsed or erected state.

Each of the third flaps 20, connected to the corner panels 14, has one side edge thereof connected by a foldline 21 to the side edge of an adjacent first flap 17. The foldline 21 is in aligned relation with the corresponding folding connection C, Ca, Cb, Cc between the first wall panel 12 and the corner panel 14. The opposite side edge of each third flap 20 is separated by an elongated slot 22 from the side edge of an adjacent second flap 18. Each foldline 21 has the outer end thereof terminating in a notch N. As noted in FIGS. 1 and 2, one side of the notch is aligned with foldline 21 and the remainder of the notch extends into the side edge of the first flap 17.

In addition to first foldline 21, each third flap 20 is provided with a second foldline 23 which extends angularly outwardly from a corner 20*a* of the flap formed by the intersection of foldlines 16, 21. The foldline 23 segregates the surface of flap 20 into a major portion I and a contiguous minor portion II. Each minor portion II, as illustrated, has a similar right angle triangular configuration with the foldline 23 being the hypotenuse of the triangle.

In setting up the blank 11 to form the receptacle, the lefthand portion of the blank, consisting of wall panel section 13*b*, adjoining corner panel 14, adjoining wall panel 12, and corresponding bottom-forming flaps 18*b*, 20, and 17, is folded as a unit about folding connection Ca so as to overlie the remainder of the blank. The righthand portion of the blank, consisting of wall panel section 13*a*, adjoining corner panel 14, and corresponding bottom-forming flaps 18*a*, 20, is folded as a unit about folding connection Cc so that a marginal edge portion of panel section 13*a* and flap section 18*a* will overlap a corresponding marginal edge portion of panel section 13*b* and flap section 18*b*. The overlapping marginal edge portions may be secured together by a row of heavy duty staples 15 or by stitching or suitable adhesive, see FIG. 2. With the blank 11 in the folded state shown in FIG. 2, which is synonymous with the receptacle in a collapsed state, it may be stored or shipped in bulk with other like blanks in the same condition.

In setting up the blank from the folded state shown in FIG. 2 to the receptacle 10 of FIG. 6, the opposing exposed sides of the folded blank, defined by the folding connections Ca and Cc, are pushed towards one another so as to form the tubular configuration shown in FIG. 3. It should be noted that the blank, when in the tubular configuration, should be supported in an inverted upright position with the bottom-forming flaps extending upwardly. While the blank is in an erected tubular shape, FIG. 3, the wall panels 12, 13 and the corner panels 14 delimit a predetermined octagonal area x.

The opposing first flaps 17 are then manually folded towards one another into the predetermined area x. Because of the folding connection between the side edges of flap 17 and the adjacent third flaps 20, the latter will simultaneously move inwardly causing the minor portions II to fold under the corresponding side edges of flap 17. As this occurs each minor portion will become sandwiched between the major portion I and the side edge portion of flap 17, see FIG. 4. It should be noted that the notches N formed at opposite ends of flaps 17 are exposed.

Figure 4:
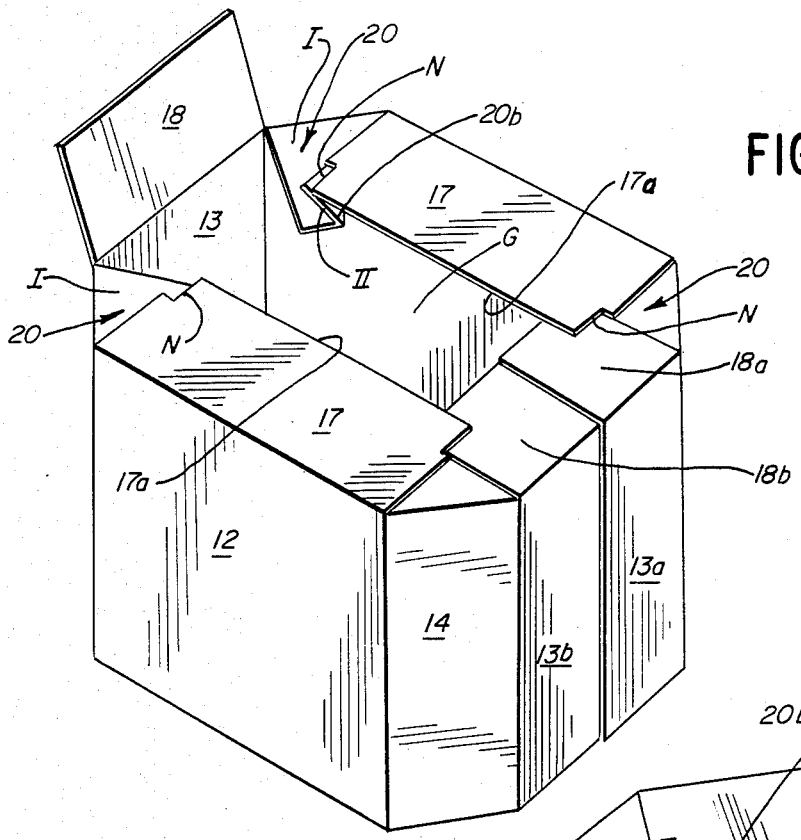

Once the flaps 17 and 20 have been folded inwardly towards one another, as seen in FIG. 4, the second flaps 18, 18*a*, 18*b* are manually folded inwardly into the area x. When the opposing side edges of flaps 18, 18*a*, 18*b* engage the inner edge portions of flaps 17 and 20, the flaps 18, 18*a*, 18*b* are pushed downwardly a sufficient amount so as to cause flaps 17 and 20 to fold downwardly as well until the gap G between the opposing inner edges 17*a* of the flaps 17 is enlarged enough to allow the flaps 18, 18*a*, 18*b* to pass therebetween and engage the inwardly extending edges 20*b* of the flaps 20. When this occurs, the side edges of flaps 18, 18*a*, 18*b* will automatically be inserted into the notches N when the pushing force is relaxed. The fight-back of the blank material will cause the flaps 17, 18, 18*a*, 18*b*, and 20 to spring upwardly and the side edges of the flaps 18, 18*a*, 18*b*, to interlock with the notches N, see FIG. 5. Once the bottom of the receptacle has been formed in the manner as described, the receptacle is turned over so that the open top T is exposed and the receptacle is ready to be loaded, see FIG. 6.

Because the flaps 20 and 17 are foldably interconnected and each flap 20 is provided with foldline 23, the segments of the receptacle bottom adjacent the corner panels 14 are reinforced by reason of the multi-thickness of the blank material as seen in FIGS. 5 and 6. Furthermore, the size of gap G may be varied, as desired, by varying the dimension of the flap 17 measured from edge 17*a* to foldline 16. The gap size should be such that the products accommodated within the receptacle cannot accidentally pass therethrough.

If receptacle 10 is to be palletized, a conventional wooden pallet P can be secured to the underside of the receptacle bottom by suitable fasteners F extending through flaps 17 into the subtending pallet.

As aforementioned, once the receptacle has been filled, a telescoping cover or overwrap, not shown, may be placed over the top T so as to close same. In lieu of either a cover or overwrap, closure flaps similar to the bottom-forming flaps aforedescribed may be foldably connected to the top edges of the wall and corner panels.

Thus, an improved bulk handling receptacle has been provided which may be stored in collapsed state when empty; may be readily set up manually from a collapsed state without the need for special tools and/or jigs; and the receptacle is readily reusable.

We claim:

1. A collapsible receptacle formed from a blank of foldable sheet material, comprisng upright first wall panels and second wall panels separated from one another by upright corner panels, each corner panel being angularly disposed relative to the adjacent first and second wall panels and interposed same and being foldably connected thereto, said corner and wall panels delimiting a predetermined area; and bottom-forming first, second, and third flaps foldably connected, respectively, to bottom edges of said first and second wall panels and said corner panels, each third flap having one side edge thereof connected by a first foldline to an adjacent side edge of one of said first flaps, an opposite side edge of each third flap being separated from the adjacent second flap by an elongated slot, the outer end of said first foldline terminating in a notch, each third flap being provided with an outwardly angularly extending second foldline forming said third flaps into contiguous major and minor portions; when forming the receptacle bottom, said first and third flaps being first folded as a unit into the predetermined area whereby the major and minor portions of each third flap are folded relative to one another into face to face relation with the minor portion being sandwiched between the major portion and an adjacent side edge portion of said first flap and then the second flaps being folded into the predetermined area whereby said edge portions of said second flaps extend through and interlockingly engage corresponding notches and are sandwiched between corresponding side edge portions of said first flaps and the minor portions of said third flaps.

2. The receptacle of claim 1 wherein each minor portion has a substantially triangular configuration.

3. The receptacle of claim 1 wherein each first flap has opposing side edges to each of which is foldably connected the minor portion of one of said third flaps.

4. The receptacle of claim 1 wherein a substantial segment of each notch extends into the surface area of the adjacent first flap.

5. The receptacle of claim 1 wherein the receptacle bottom has segments thereof adjacent said corner panels formed of multi-thickness of sheet material.

6. The receptacle of claim 1 wherein each minor portion subtends the major portion to which it is connected by the second foldline.

7. A blank of foldable sheet material for forming a collapsible receptacle comprising a plurality of first wall panels; a plurality of second wall panels; a plurality of corner panels, said panels being foldably interconnected and arranged in side-by-side relation with a corner panel disposed between adjacent first and second wall panels; and first, second, and third bottom-forming flaps foldably connected, respectively, to corresponding bottom edges of said first and second wall panels and said corner panels, each third flap having one side edge thereof connected by a first foldline to a side edge of an adjacent first flap, a second side edge of each third flap being separated by an elongated slot from a side edge of an adjacent second flap, the outer end of each first foldline terminating in a notch, each third flap being provided with an outwardly angularly extending second foldline forming said third flap into contiguous major and minor portions whereby, when said blank is setup to form a receptacle, the corresponding major and minor portions are in folded face-to-face relation and a side edge portion of the second flap is in interlocking engagement with a notch and is sandwiched between the minor portion and an adjacent side edge portion of a first flap.

8. The blank of claim 7 wherein the second foldine of each third flap extends angularly from a corner of the third flap formed by the intersection of the first foldline and the folding connection between said third flap and a corner panel.

* * * * *